US007894712B2

(12) United States Patent
Karlsson et al.

(10) Patent No.: US 7,894,712 B2
(45) Date of Patent: Feb. 22, 2011

(54) HEATER, A HEATING ELEMENT AND A BLOWER FAN

(75) Inventors: Hans Karlsson, Linköping (SE); Rikard Wallman, Linköping (SE)

(73) Assignee: Fergas AB, Linkoping (SE)

( * ) Notice: Subject to any disclaimer, the term of this patent is extended or adjusted under 35 U.S.C. 154(b) by 683 days.

(21) Appl. No.: 10/591,656

(22) PCT Filed: Mar. 2, 2005

(86) PCT No.: PCT/SE2005/000310

§ 371 (c)(1),
(2), (4) Date: Jul. 9, 2007

(87) PCT Pub. No.: WO2005/085713

PCT Pub. Date: Sep. 15, 2005

(65) Prior Publication Data

US 2008/0037963 A1 Feb. 14, 2008

(30) Foreign Application Priority Data

Mar. 3, 2004 (EP) ..... 04004971

(51) Int. Cl.
*A45D 20/10* (2006.01)
*A47B 95/02* (2006.01)

(52) U.S. Cl. ..... 392/385; 16/110

(58) Field of Classification Search ..... 392/379–385; 16/110.1–430

See application file for complete search history.

(56) References Cited

U.S. PATENT DOCUMENTS

| | | | | |
|---|---|---|---|---|
| 2,015,251 | A | 9/1935 | Browning | |
| 2,655,587 | A | 10/1953 | Steingruber | |
| 2,986,622 | A | 5/1961 | Brazda | |
| 3,742,189 | A | 6/1973 | Conroy et al. | |
| 4,703,153 | A | 10/1987 | Pelonis | |
| 4,737,616 | A | 4/1988 | Wen-Ying | |
| 4,809,593 | A | 3/1989 | Asselbergs | |
| 5,256,857 | A | 10/1993 | Curhan et al. | |
| 5,443,364 | A | 8/1995 | Mistry et al. | |
| 5,513,296 | A | 4/1996 | Goldstein | |
| 5,778,144 | A * | 7/1998 | McDougall | 392/385 |
| 7,326,883 | B2 * | 2/2008 | Bertani | 219/400 |

FOREIGN PATENT DOCUMENTS

| | | | |
|---|---|---|---|
| DE | 12 12 703 | B | 3/1966 |
| DE | 39 08 512 | A | 9/1989 |
| GB | 996056 | A | 6/1965 |
| GB | 1178549 | A | 1/1970 |
| GB | 2089626 | A | 6/1982 |
| GB | 2151772 | A | 7/1985 |
| GB | 2251935 | A | 7/1992 |

* cited by examiner

*Primary Examiner*—Daniel Robinson
(74) *Attorney, Agent, or Firm*—Harness, Dickey & Pierce, P.L.C.

(57) ABSTRACT

A heater for an electrical fireplace comprises a heating element (1) and a blower fan (2), the blower fan (2) being releasably attached to the heating element (1). Interacting members (9*a*1-3, 9*a*2', 9*b*1-3, 9*b*1', 9*b*3', 14*a*1-3, 14*b*1) are provided on the heating element (1) and on the blower fan (2), which members (9*a*1-3, 9*a*2', 9*b*1-3, 9*b*1', 9*b*3', 14*a*1-3, 14*b*1) are designed to be, engaged with one another to hold the heating element (1) in position relative the blower fan (2).

4 Claims, 3 Drawing Sheets

HEATER, A HEATING ELEMENT AND A BLOWER FAN

TECHNICAL FIELD OF THE INVENTION

The present invention generally relates to heaters, especially for electrical fireplaces. More specifically, the present invention relates to a heater having an electrical heating element and a blower fan. The Invention also relates to a heating element and to a blower fan for use in the above mentioned heater.

TECHNICAL BACKGROUND AND SUMMARY OF THE INVENTION

Heaters comprising electrical heating elements and fans for circulating the air, i.e. blower fans, are included in various arrangements such as electrical fan wall heaters and electrical fireplaces. For example, U.S. Pat. No. 6,564,485 B1 discloses an electrical fireplace that simulates an actual wood-burning fireplace having flames emanating from a bed of logs and glowing embers, and which electrical fireplace includes a heater assembly located in the top of housing of the fireplace. The heater assembly comprises a heating element connected to a tangential blower fan.

During the life cycle of heaters, the heating elements are more susceptible to failure and have to be replaced more often than the fans. Existing heaters for electrical fireplaces comprise heating elements that are connected to tangential blower fans using pop rivets or screws. A drawback with such heaters is in the case of, for example, a defective heating element, that the replacement of such a heating element becomes time-consuming and costly, since the heating element and the fan is replaced as a unit. Another drawback is that the manufacturing of such heaters is time-consuming and costly.

SUMMARY OF THE INVENTION

In view of the aforementioned respects of known heaters, an object of the present invention is to provide an improved heater.

The object is wholly or partially achieved by a heater, a heating element and a blower fan according to the respective independent claim. Embodiments are set forth in the appended dependent claims, in the following description and in the drawings.

According to a first aspect of the invention there is provided a heater for an electrical fireplace, which heater comprises a heating element and a blower fan, wherein the blower fan is releasably attached to the heating element. Interacting members are provided on the heating element and on the blower fan, which members are designed to be engaged with one another to hold the heating element in position relative the blower fan, whereby the blower fan is releasably attached to the heating element.

The invention provides a heater which can be assembled more quickly, and whose heating element can be easily replaced, since the defective heating element may be easily detached from the blower fan and replaced by a new heating element.

In one embodiment, the members may be snap lock members that are designed to be positively engaged with one another.

In one embodiment, the snap lock members may comprise first and second snap lock members, the first snap lock member having at least one pin designed to be positively engaged with the second snap lock member, such that the pin fits in a form fit manner within an opening arranged on the second snap lock member.

In one embodiment, at least one snap lock member may be resilient. For example, at least one of said snap lock members can be made from a resilient material.

In one embodiment, the pin may be arranged on a resilient tongue.

In one embodiment, the interacting members may be designed to be frictionally engaged with one another.

In one embodiment, the blower fan is a tangential blower fan.

According to a second aspect of the invention there is provided heating element having a member designed to engage with a corresponding member on the blower fan, such that the heating element is releasably attachable to the blower fan. The member on said heating element may be a snap lock member adapted to be positively engaged with a corresponding member on said blower fan.

According to a third aspect of the invention there is provided blower fan having a member designed to engage with a corresponding member on a heating element, such that the blower fan is releasably attachable to the heating element. The member on said blower fan may be a snap lock member adapted to be positively engaged with a corresponding member on said heating element.

The invention will now be explained in more detail below with reference to the attached drawings showing an embodiment of the invention.

DESCRIPTION OF AN EMBODIMENT OF THE INVENTION

Figure 1:
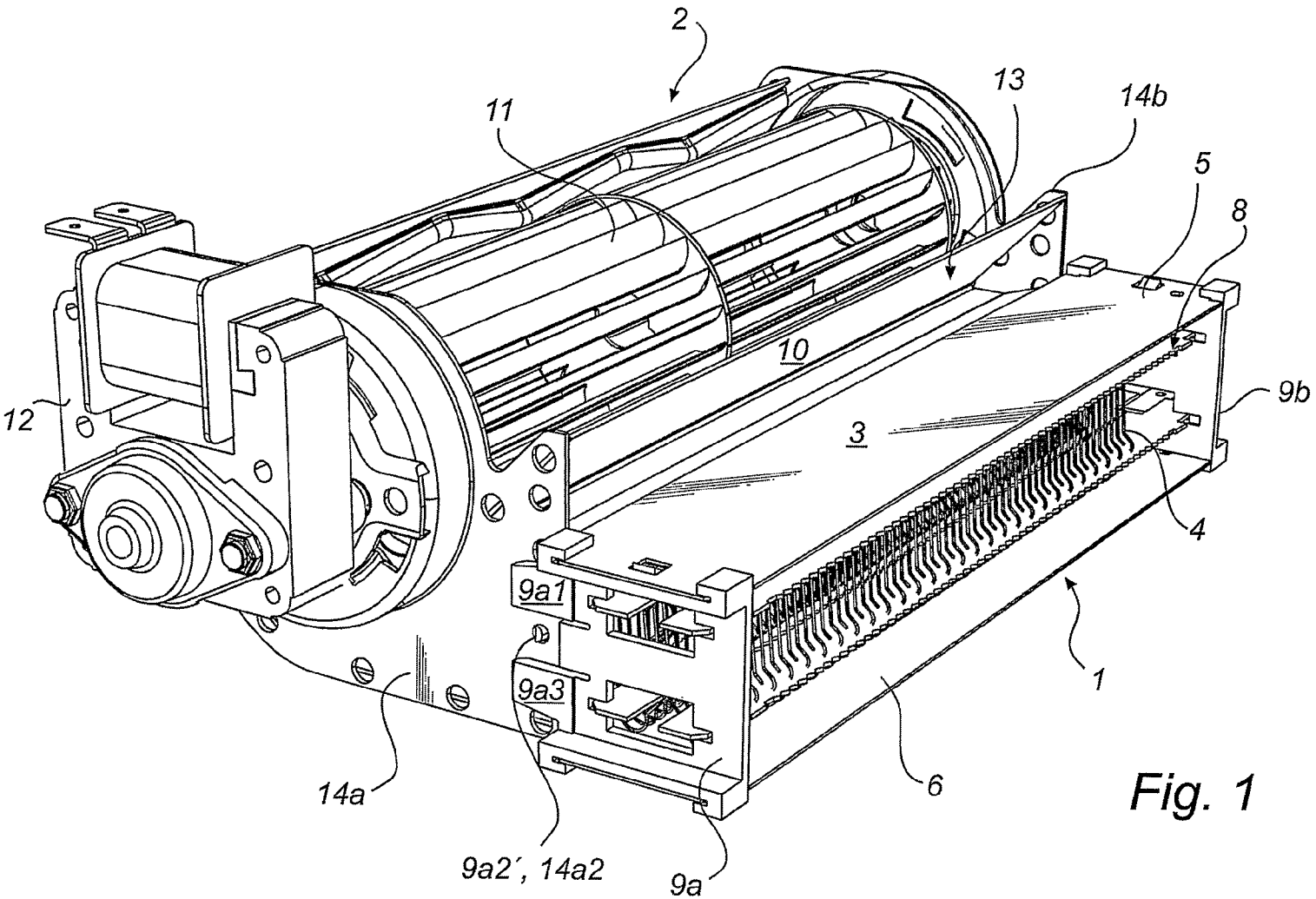
FIG. 1 is a pictorial view of a heating element 1 and a tangential blower fan 2 according to the invention.
Figure 2:
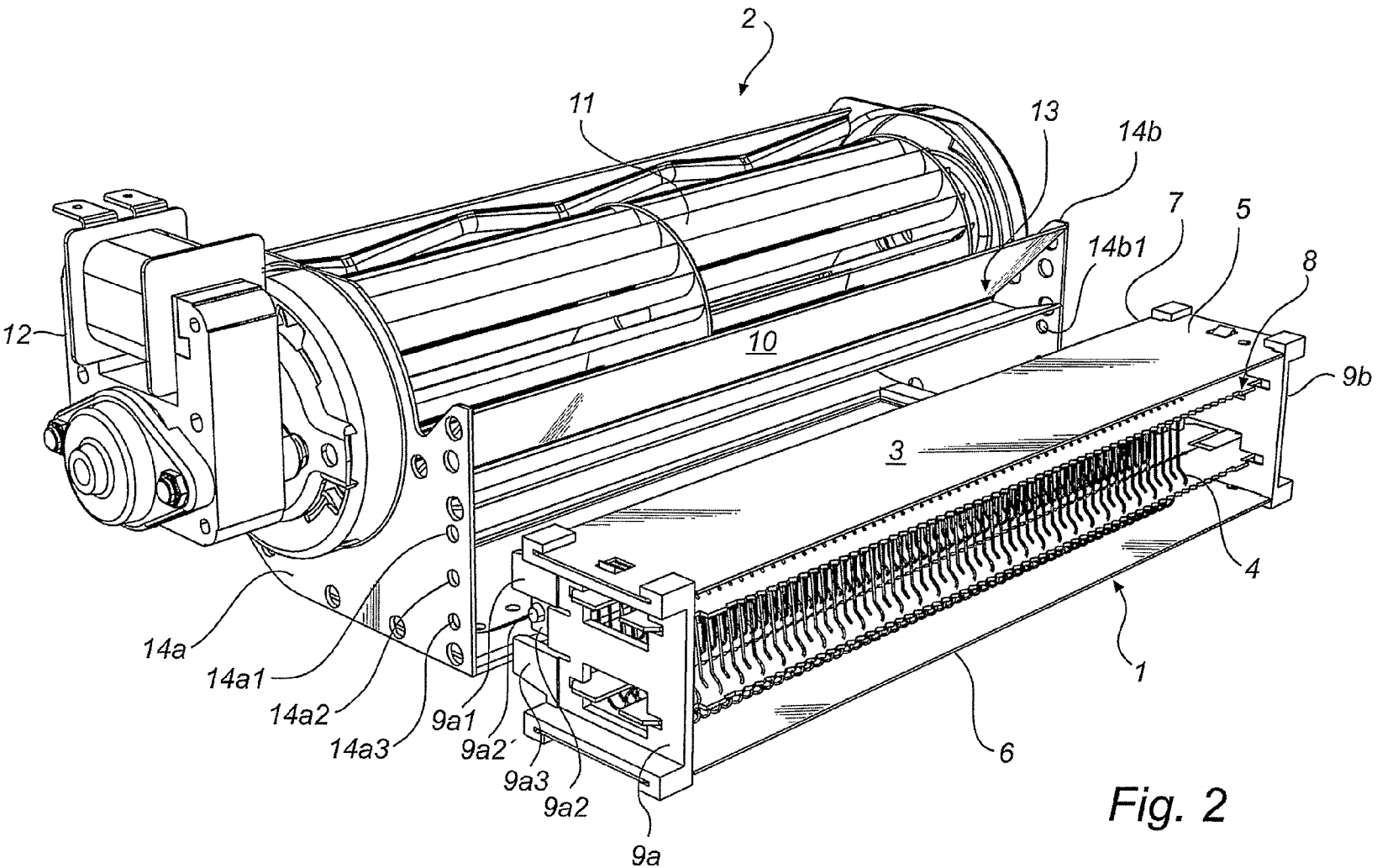
FIG. 2 is a pictorial view of a heating element 1 and a tangential blower fan 2 as in FIG. 1 wherein the heating element 1 and the fan 2 are locked relative one another by means of interacting snap lock members 9*a*1-3, 9*a*2', 9*b*1-3, 9*b*1', 9*b*3', 14*a*1-3, 14*b*1 that are positively engaged with one another.
Figure 3:
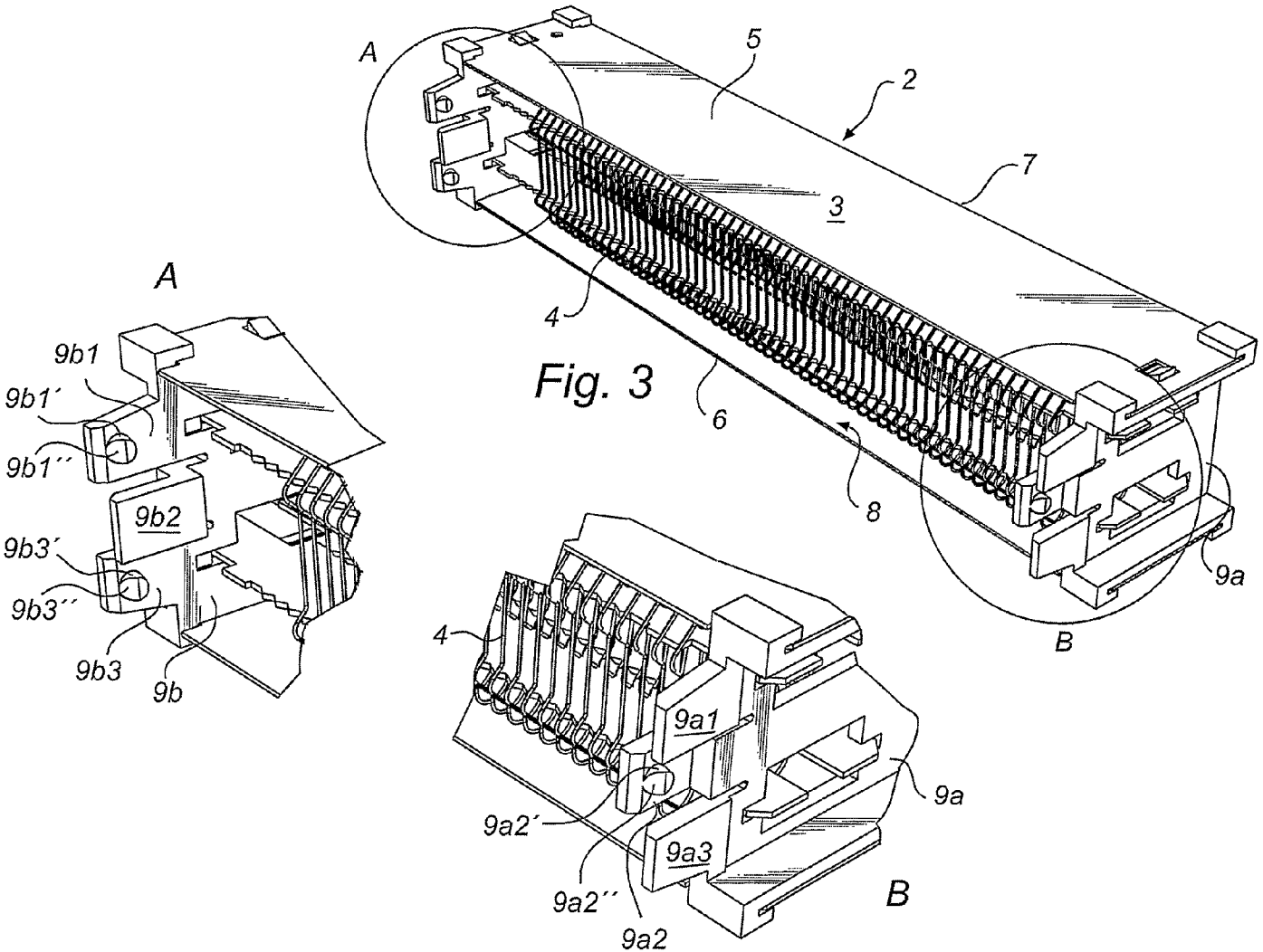
FIG. 3 illustrates the heating element 1, and provides a close-up view of its snap lock members 9*a*1-3, 9*a*2', 9*b*1-3, 9*b*1', 9*b*3'.

According to one embodiment of the invention, a heater for an electrical fireplace is provided, which heater comprises a heating element 1 and a tangential blower fan 2.

The heating element 1 has a housing 3, within which housing 3 electrically resistive wires 4 are arranged for heating an air flow passing through the heating element 1. The heating element 1 has an upper part 5, a lower part 6, a rear part 7, a front part 8 and two short sides 9*a*, 9*b*. The rear part 7 and the front part 8 are open, in order to provide air inlet and outlet, respectively.

The tangential blower fan 2 has a fan housing 10 and within the housing 10 a fan wheel 11, which in turn is connected via its axle to an electrical motor 12, which is arranged outside the fan housing 10. The fan housing 10 has a front part 13 which is plane and rectangular, and which front part 13 has an opening working as an air outlet. The front part 13 of the fan housing 10 is connectable to the rear part 7 of the heating element 1. In this way, air can flow into the heating element 1 from the fan 2, when the heating element 1 is connected to the fan 2.

Further, on the fan housing 10 there are two short sides 14*a*, 14*b* substantially perpendicular to the plane of the front part 13 of the fan housing 10. The planes of the short sides 9*a*, 9*b* of the heating element 1 are parallel with the respective plane of the short sides 14*a*,14*b* of the fan housing 10 when the heating element 1 is connected to the fan 2.

Each short side 9*a*, 9*b* of the heating element 1 has a first snap lock member 9*a*1-3, 9*a*2', 9*b*1-3, 9*b*1', 9*b*3' that is designed to be positively engaged with corresponding second snap lock member 14*a*1-3, 14*b*1 that is arranged on the respective short side 14*a*, 14*b* of the fan housing 10.

In the described embodiment, each short side 9*a*, 9*b* of the heating element 1 comprises three pins 9*a*2', 9*b*1', 9*b*3', each pin 9*a*2', 9*b*1', 9*b*3' being arranged to protrude from a flexibly arranged tongue 9*a*1-3, 9*b*1-3, which is resilient in a direction substantially perpendicular to the respective short side 9*a*, 9*b* of the heating element 1. In one embodiment, the tongues 9*a*1-3, 9*b*1-3 are plane parallel with the respective short side 9*a*, 9*b* and protrude from the rear part 7 of the heating element 1.

Each pin 9*a*2', 9*b*1', 9*b*3' is provided with a locking section adapted to interact with a locking surface arranged in a corresponding opening 14*a*1-3, 14*b*1 in one of the short sides 14*a*, 14*b* of the fan 2, close to the front edge of the short side 14*a*, 14*b* of the fan 2.

When the heating element 1 is connected to the fan 2, first and second tongues 9*a*1, 9*a*3, 9*b*1, 9*b*3 on each short side 9*a*, 9*b* of the heating element 1 are located outside the respective short side 14*a*, 14*b* of the fan housing 10 with the pins 9*b*1', 9*b*3' protruding inward the housing 10 through the openings 14*a*1, 14*a*3, 14*b*1 in the corresponding short side 14*a*, 14*b* of the fan 2. A third tongue 9*a*2, 9*b*2 is located on the inside of the fan housing 10 having its pin 9*a*2' protruding outward the housing 10 through a corresponding opening 14*a*2 in the corresponding short side 14*a*, 14*b* of the fan 2.

Each tongue 9*a*1-3, 9*b*1-3 is resilient, which characteristics can be provided by the tongue 9*a*1-3, 9*b*1-3 being made from e.g. a thermoplastic material. In the case where the short sides 9*a*, 9*b* of the heating element 1 are also made from a thermoplastic material, the tongues 9*a*1-3, 9*b*1-3 and the pins 9*a*2', 9*b*1', 9*b*3' may be formed in one piece with the respective short side 9*a*, 9*b*, e.g. by injection moulding.

When the heating element 1 is being connected to the fan 2, the heating element 1 and the fan 2 are moved towards one another with the rear part 7 of the heating element 1 facing the front part 13 of the fan 2, whereby the tongue 9*a*1-3, 9*b*1-3 and the pins 9*a*2', 9*b*1', 9*b*3' on the heating element 1 are pressed resiliently by the front edges of the short sides 14*a*, 14*b* of the fan housing 10 from their normal positions. The first and second pins 9*b*1', 9*b*3' are forced in the direction outward from the fan housing 10 and the third pins 9*a*2' are pressed in the direction towards the inside of the fan housing 10. When the pins 9*a*2', 9*b*1', 9*b*3' match the corresponding openings 14*a*1-3, 14*b*1 in the short sides 14*a*, 14*b* of the fan 2, the tongues 9*a*1-3, 9*b*1-3 force the pins 9*a*2', 9*b*1', 9*b*3' to spring back towards their normal position and thereby the pins 9*a*2', 9*b*1', 9*b*3' are brought into engagement with the corresponding openings 14*a*1-3, 14*b*1 in the short sides 14*a*, 14*b* of the fan 2. Accordingly, the snap lock members 9*a*1-3, 9*a*2', 9*b*1-3, 9*b*1', 9*b*3', 14*a*1-3, 14*b*1 are positively engaged.

In one embodiment, each pin 9*a*2', 9*b*1', 9*b*3' may be provided with a ramp surface 9*a*2", 9*b*1", 9*b*3" for facilitating the engagement of the snap lock, by forcing the respective tongue 9*a*1-3, 9*b*1-3 to deflect from its respective normal position.

In one further embodiment, the short sides 14*a*, 14*b* of the fan 2 may be made wholly or partially resilient, so as to be able to flex during engagement of the snap lock. For example, each opening may be provided on a resilient tongue. Alternatively, the wall of the short sides 14*a*, 14*b* of the fan housing 10 may be slitted on two opposite sides of the opening 14*a*1-3, 14*b*1, such that a tongue is provided.

In a second embodiment (not shown), the tongues and pins are provided on the fan housing 10, whereas the openings are provided on the heating element 1.

In yet another embodiment, one or more tongues and pins are provided on the fan housing 10 and one or more tongues and pins are provided on the heating element 1, the openings being provided in a corresponding manner on the respective component.

The invention claimed is:

1. A heater for an electrical fireplace, which heater comprises a heating element and a blower fan, the blower fan being releasably attached to the heating element via interacting members that are provided on the heating element and on the blower fan, which members are designed to be positively engaged with one another to hold the heating element in position relative the blower fan, wherein the interacting members are snap lock members comprising first and second snap lock members, the first snap lock member having at least one pin designed to be positively engaged with the second snap lock member, such that the pin fits in a form fit manner within an opening arranged on the second snap lock member, and wherein at least one of said snap lock members is made from a resilient material, wherein the pin is arranged on a resilient tongue.

2. The heater as claimed in claim 1, in which the blower fan is a tangential blower fan.

3. A heater for an electrical fireplace, which heater comprises a healing element and a blower fan, the blower fan being releasably attached to the heating element via interacting members that are provided on the heating element and on the blower fan, which members are designed to be positively engaged with one another to hold the heating element in position relative the blower fan, wherein the interacting members are snap lock members comprising first and second snap lock members, the first snap lock member having at least one pin designed to be positively engaged with the second snap lock member, such that the pin fits in a form fit manner within an opening arranged on the second snap lock member, and wherein at least one of said snap lock members is made from a resilient material, wherein the heating element includes a first interacting member designed to be positively engaged with a corresponding second interacting member on the blower fan, to hold the heating element in position relative the blower fan, whereby the heating element is releasably attachable to the blower fan, wherein the first interacting member is a first snap lock member and wherein said first snap lock member is made from a resilient material.

4. A heater for an electrical fireplace, which heater comprises a heating element and a blower fan, the blower fan being releasably attached to the heating element via interacting members that are provided on the heating element and on the blower fan, which members are designed to be positively engaged with one another to hold the heating element in position relative the blower fan, wherein the interacting members are snap lock members comprising first and second snap lock members, the first snap lock member having at least one pin designed to be positively engaged with the second snap lock member, such that the pin fits in a form fit manner within an opening arranged on the second snap lock member, and wherein at least one of said snap lock members is made from a resilient material wherein the blower fan includes a first interacting member designed to be positively engaged with a corresponding second interacting member on the heating element, to hold the blower fan in position relative the heating element, whereby the blower fan is releasably attachable to the heating element wherein the first interacting member fan is a first snap lock member, and wherein said first snap lock member is made from a resilient material.

* * * * *